US006641548B2

(12) United States Patent
Elnar

(10) Patent No.: US 6,641,548 B2
(45) Date of Patent: Nov. 4, 2003

(54) WATER DRIVEN VIBRATING MASSAGER

(76) Inventor: Joseph G. Elnar, 12579 Canyon Wind Rd., Riverside, CA (US) 92503

( * ) Notice: Subject to any disclaimer, the term of this patent is extended or adjusted under 35 U.S.C. 154(b) by 0 days.

(21) Appl. No.: 10/068,990

(22) Filed: Feb. 11, 2002

(65) Prior Publication Data

US 2003/0153851 A1 Aug. 14, 2003

(51) Int. Cl.[7] ..... A61H 9/00
(52) U.S. Cl. ..... 601/155; 601/154
(58) Field of Search ..... 4/606; 601/75, 601/76, 154–160, 167–169, 55

(56) References Cited

U.S. PATENT DOCUMENTS

| | | | | |
|---|---|---|---|---|
| 1,198,544 A | | 9/1916 | Heal | |
| 1,948,167 A | | 2/1934 | Cornwell | |
| 4,313,432 A | | 2/1982 | Sievers | |
| 4,441,488 A | * | 4/1984 | Macabee | |
| 4,508,665 A | * | 4/1985 | Spinnett | 261/93 |
| 4,709,691 A | * | 12/1987 | Lemons et al. | 601/160 |
| 4,797,958 A | * | 1/1989 | Guzzini | 4/541.2 |
| 4,813,086 A | * | 3/1989 | Henkin et al. | 4/541.6 |
| 5,054,474 A | * | 10/1991 | Jacob et al. | 601/160 |
| 5,467,927 A | * | 11/1995 | Lee | 239/383 |
| 5,810,262 A | * | 9/1998 | Ton | 239/428.5 |
| 5,820,574 A | * | 10/1998 | Henkin et al. | 601/160 |
| 5,984,883 A | * | 11/1999 | Elnar | 601/86 |

FOREIGN PATENT DOCUMENTS

JP 2-218316 * 8/1990

* cited by examiner

*Primary Examiner*—Justine R. Yu
(74) *Attorney, Agent, or Firm*—Edgar W. Averill, Jr.

(57) ABSTRACT

A water driven vibrating massager mounted in an opening in the wall of a spa. The massager is supported in a massager mounting frame secured in the opening in the wall of the spa. The mounting frame has a frame elastic member support portion extending inwardly from the frame. An elastic member is held by the elastic member support portion, which in turn holds a massager body. The massager body extends interiorly to a support area on the mounting frame and an inner elastic member is held between the support area on the mounting frame and a support portion on the massager body. The massager body fits within a mounting frame for a water jet and the process of the present invention includes the unscrewing of a locking ring and the removal of a water jet followed by the insertion of the massager body and the replacement of the locking ring. In this way, the massager body can be placed at any position where a spa jet is held.

9 Claims, 2 Drawing Sheets

WATER DRIVEN VIBRATING MASSAGER

BACKGROUND OF THE INVENTION

The present invention is for a water driven vibrating massager mounted in an opening in the wall of a spa and the process for mounting the massager. Water driven massagers are known and one such massager is shown in U.S. Pat. No. 1,198,544. The vibrator utilizes an unbalanced rotor, which is impacted by a stream of water, which then passes outwardly through a screen on the face of the rotor.

U.S. Pat. No. 1,948,167 shows a vibration device which also uses an eccentric rotor, which is turned by a jet of water.

U.S. Pat. No. 4,313,432 is a water driven personal massager, which directs a stream of water against an eccentrically weighted turbine. The water passes outwardly through holes in the body of the massager.

BRIEF SUMMARY OF THE INVENTION

It is an object of the present invention to provide a water driven vibrating massager which may be mounted in an opening in a spa wall and preferably in an opening which is capable of supporting a water jet.

The present invention is for a water driven vibrating massager mounted in an opening in the wall of a spa. A spa wall has an opening with an outer surface and an inner surface and a massager mounting frame is secured in the opening. The mounting frame has a frame elastic support portion extending inwardly with respect to the opening and the massager mounting frame extends interiorly with respect to the inner surface of the opening in the spa wall to an inner massager body support wall. A massager body is held by said massager mounting frame by at least one elastic member held between the elastic member support portion of the mounting frame and a massager body elastic member support portion extending outwardly from the massager body. The massager body extends interiorly to a support area adjacent the inner massager body support wall. An outer elastic member has an outer portion held by the frame elastic member support portion and an inner portion held by said massager elastic member support portion. An inner elastic member is held between the inner massager body support wall of the frame and the support area of the massager body. The massager body has an inner water passageway, having a water inlet in an inner end of the massager body and a water outlet near a massager surface, positioned in said massager body outwardly with respect to said outer surface of said opening of said spa wall.

An eccentrically weighted turbine is positioned in the inner water passageway and is rotatingly supported by the massager body. The turbine includes means for being turned by the flow of water past the turbine. When water passes into the water inlet of the massager body, it causes the eccentrically weighted turbine to turn, thereby vibrating the massager body and the massager surface thereof. Preferably, the weighted turbine has an axis of rotation parallel to the inner water passageway. Also preferably, the outer elastic member comprises a pair of elastic rings surrounded by a support flange held by the massager body. The massager surface of the massager preferably forms a peripheral wall surrounding a central opening and the water outlet passes outwardly through this central opening. Preferably, the inner elastic member is an O-ring.

The turbine may be made from a cylindrical member with compartments on an outer periphery thereof, some of the compartments containing weights. The turbine may have an annular ring for the passage of water, which annular ring contains angled veins.

The present invention is also for the process for installing a massager in the wall of a spa. The spa has a plurality of water jets in the wall in water jet bodies by a locking ring. The water jet is removed by unscrewing the locking ring and pulling the water jet out of its mounting frame. Then a massager body is inserted into the mounting frame of the water jet and the locking ring is locked over the massager body.

DESCRIPTION OF THE PREFERRED EMBODIMENTS

Figure 1:
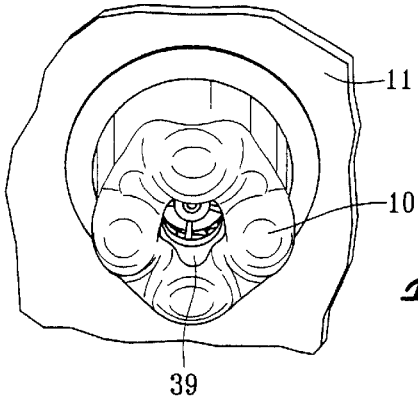
FIG. 1 is a perspective view of the massager surface of the water driven vibrating massager of the present invention.
Figure 3:
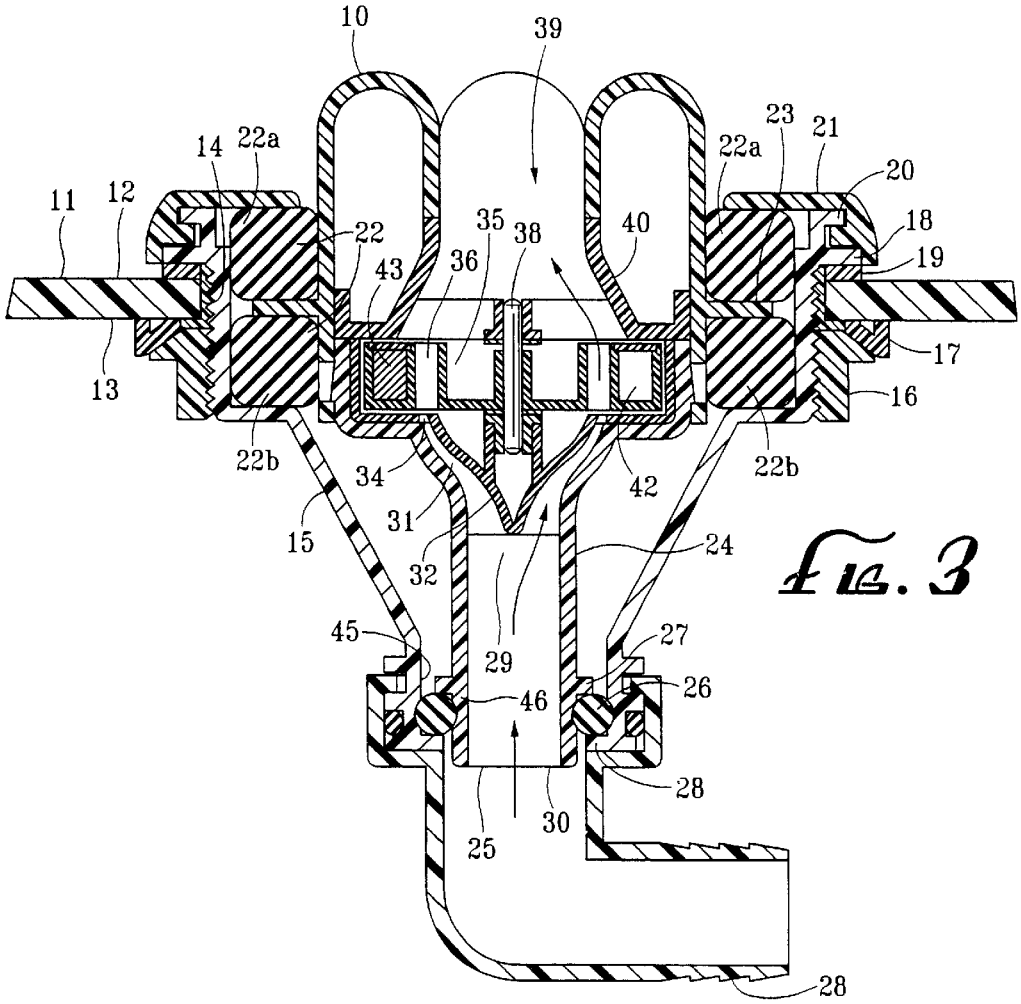
FIG. 3 is a cross-sectional view thereof.

A massager surface 10 extends outwardly from spa wall 11, and thus, may be contacted by the user of the spa. The massager surface 10 is preferably mounted below the water surface of the spa. The water driven vibrating massager is shown in exploded perspective view in FIG. 2 and in cross-sectional view in FIG. 3. Referring to FIG. 3, spa wall 11 has an outer surface 12 and an inner surface 13. A spa wall opening 14 is formed through the wall and a conventional jet mounting frame forms massager mounting frame 15. Mounting frame 15 is held against the outer surface 12 of spa wall 11 by a nut 16, which abuts a washer 17. Nut 16 pulls a flange 18 against a washer 19 which is in contact with outer surface 12 of spa wall 11. Massager mounting frame 15 has a bayonet locking flange 20 under which a bayonet locking ring 21 may be tightened.

Locking ring 21 abuts an outer elastic member 22, which has an outer portion 22A and an inner portion 22B. Portions 22A and 22B surround a massager body elastic member support portion 23, which is also referred to herein as a support flange 23. These elastic members permit a significant amount of movement of massager surface 10. Massager body 24 is also supported at its inner end 25 by an inner elastic member 26 which comprises an O-ring. O-ring 26 is held between inner body flange 27 and inner frame flange 28. Water enters the massager body 24 through inlet fitting 28 which is sealingly secured to the interior end of massager mounting frame 16. This causes an inner water passageway 29 to flow through water inlet 30. The water is diverted into an annular passageway 31 by diverter 32 and outwardly through openings 34. An eccentrically weighted turbine 35 has an annular ring 36 which has angled veins 37 shown in FIG. 2. Thus, the passage of water through annular passageway 31 and openings 34 causes the turbine 35 to rotate about its central shaft 38. The water, after passing through annular ring 36, exits through outlet 39 in the center of massager surface 10.

Figures 2, 4:
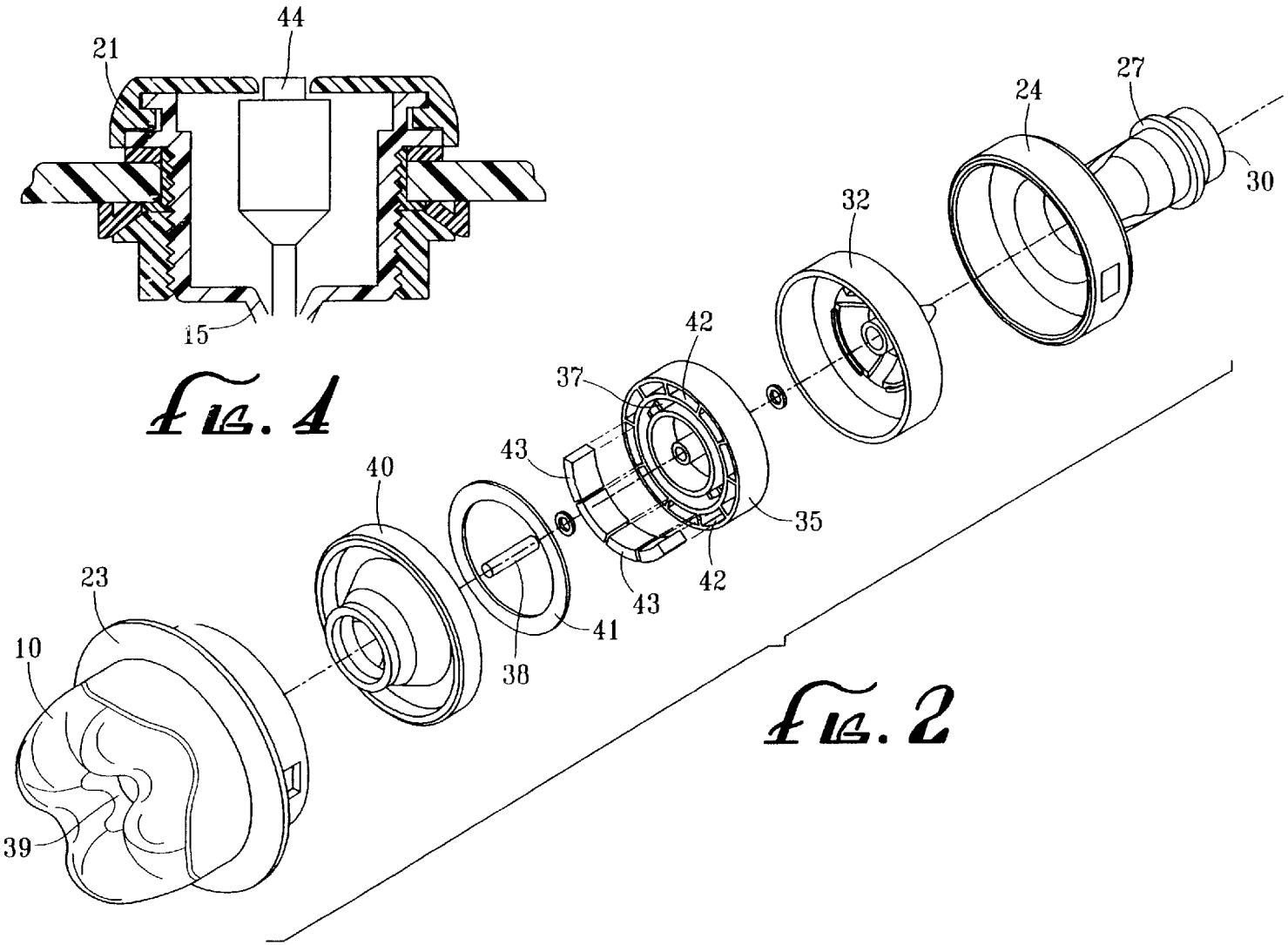
FIG. 2 is an exploded perspective view thereof.
FIG. 4 is a cross-sectional view of a water jet mounted in an opening in a spa wall.

Viewing FIG. 2, the parts of the massager include the massager surface portion 10, which includes support flange 23. An outer water diverter 40 directs the water into water outlet 39. A washer 41 assists in sealing the outer water diverter to inner water diverter 32. The eccentrically weighted turbine 35 has a plurality of compartments 42, some of which contain weights 43. This, of course, causes the turbine to be eccentric and its turning causes the massager to vibrate. The lower portion of the massager body 24 is snapped onto the upper portion of the massager body.

A very useful feature of the construction of the present invention is its ability to be inserted into a water jet body, which is the same as massager mounting frame 15. As shown in FIG. 4, a water jet 44 is held in mounting frame 15 by locking ring 21. When locking ring 21 is unscrewed, water jet 44 may be pulled out of mounting frame 15. Then massager body 24 may be inserted therein. Next, locking ring 21 is replaced, locking the massager in the opening formerly occupied by water jet 44. In this way, the massager can be placed in any position where there was a water jet, thus providing a very wide degree of flexibility in positioning of the massager.

By mounting the massager between two elastic members 22A and 22B near an outer end, and by a smaller inner elastic member 26 between an inner body support wall 45 and a support area 46 adjacent inner body flange 27, the massager is capable of substantial movement at the massager surface 10. Unlike any spa accessories, the amount of plumbing required for installation is nil.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A water driven vibrating massager mounted in an opening in the wall of a spa, said massager and spa wall opening comprising:

a spa wall having an opening with an outer surface and an inner surface;

a massager mounting frame secured in the opening, said mounting frame having a frame elastic member support portion extending inwardly with respect to said opening and said massager mounting frame extending interiorly with respect to the inner surface of said opening in said spa wall to an inner massage body support wall of said massager mounting frame;

a massager body held by said massager mounting frame by at least one outer elastic member and at least one inner elastic member, said outer elastic member held between said mounting frame and a massager body elastic member support portion extending outwardly from said massager body and said massager body extending interiorly to a support area of said massager body adjacent said inner massager body support wall of said massager mounting frame;

an outer elastic member having an outer portion held by said frame elastic member support portion an inner portion held by said massager elastic member support portion;

an inner elastic member held between said inner massager body support wall of said massager mounting frame and said support area of said massager body;

said massager body having an inner water passageway having a water inlet at an inner end of said massager body and a water outlet near a massager surface held by said massager body outward with respect to said outer surface of said spa wall; and an eccentrically weighted turbine rotatingly held by said massager body positioned in said inner water passageway and rotatingly supported by said massager body and said turbine including means for causing the turbine to turn by the flow of water past said turbine whereby when water passes into said water inlet of said massager body, it causes said eccentrically weighted turbine to turn thereby vibrating said massager body and the massager surface thereof.

2. The water driven vibrating massager of claim 1 wherein said eccentrically weighted turbine has an axis of rotation parallel to said inner water passageway.

3. The water driven vibrating massager of claim 1 wherein said outer elastic member comprises a pair of elastic rings surrounding a support flange held by said massager body.

4. The water driven vibrating massager of claim 1 wherein said massager surface forms a peripheral wall surrounding a central opening and said water outlet passes outwardly through said central opening.

5. The water driven vibrating massager of claim 1 wherein said inner elastic member is an O-ring.

6. The water driven vibrating massager of claim 1 wherein said massager body is removable from the spa wall and replaceable in the spa wall by a water jet fitting.

7. The water driven vibrating massager of claim 1 wherein said eccentrically weighted turbine comprises a cylindrical member fabricated from a polymer and having a plurality of compartments on an outer periphery thereof some of said plurality of compartments containing weights.

8. The water driven vibrating massager of claim 1 wherein said turbine has an annular ring for the passage of water and said annular ring contains angled vanes.

9. A process for installing a massager in the wall of a spa, said spa being of the type having a plurality of water jets held in said wall of said spa below a waterline thereof, said water jets comprising water jet bodies each being held in a mounting frame held by said spa wall by a locking ring, said mounting frame including an outwardly facing support ring, said process comprising:

removing said locking ring and pulling one of said water jet bodies out of said mounting frame;

inserting an inner portion of an elastic member support ring assembly against said outwardly facing support ring;

inserting a massager body having an inner water passageway containing an eccentrically weighted turbine into said mounting frame, said massager body having a massager surface extending outwardly from an outer end of said massager body and said massager body having an elastic member support flange and said inserting step including placing said elastic member support flange against said inner portion of said elastic member support ring;

inserting an outer portion of an elastic member support ring assembly against said elastic member support flange of said massager body; and locking said locking ring over said massager body and against said outer portion of said elastic member support ring assembly whereby the water which formerly passed outwardly through said water jet body passes through said massager body and operates the eccentrically weighted turbine whereby a massager is adapted to be inserted in any of the locations formerly holding a water jet.

* * * * *